US008701480B2

(12) United States Patent
Eriksen

(10) Patent No.: US 8,701,480 B2
(45) Date of Patent: Apr. 22, 2014

(54) DOWNHOLE PRESSURE AND VIBRATION MEASURING DEVICE INTEGRATED IN A PIPE SECTION AS A PART OF A PRODUCTION TUBING

(75) Inventor: Egil Eriksen, Foldrøyhamn (NO)

(73) Assignee: Tool-Tech AS, Rykkinn (NO)

( * ) Notice: Subject to any disclaimer, the term of this patent is extended or adjusted under 35 U.S.C. 154(b) by 250 days.

(21) Appl. No.: 13/132,072

(22) PCT Filed: Nov. 20, 2009

(86) PCT No.: PCT/NO2009/000399
§ 371 (c)(1),
(2), (4) Date: Sep. 19, 2011

(87) PCT Pub. No.: WO2010/064919
PCT Pub. Date: Jun. 10, 2010

(65) Prior Publication Data

US 2012/0024052 A1 Feb. 2, 2012

(30) Foreign Application Priority Data

Dec. 2, 2008 (NO) ..... 20085042

(51) Int. Cl.
*E21B 47/06* (2012.01)

(52) U.S. Cl.
USPC ..... 73/152.51

(58) Field of Classification Search
USPC ..... 73/152.51–152.53, 152.47–152.49, 73/587, 152.58
See application file for complete search history.

(56) References Cited

U.S. PATENT DOCUMENTS

| | | | | |
|---|---|---|---|---|
| 3,713,334 | A * | 1/1973 | Vann et al. | 73/152.14 |
| 4,144,768 | A * | 3/1979 | Andersson et al. | 73/646 |
| 4,805,449 | A * | 2/1989 | Das | 73/152.48 |
| 5,226,494 | A | 7/1993 | Rubbo et al. | |
| 5,343,963 | A * | 9/1994 | Bouldin et al. | 175/27 |
| 6,055,213 | A | 4/2000 | Rubbo et al. | |
| 6,435,030 | B1 | 8/2002 | Gysling et al. | |
| 6,802,215 | B1 * | 10/2004 | Boucher et al. | 73/152.48 |
| 6,957,574 | B2 * | 10/2005 | Ogle | 73/152.48 |
| 6,957,575 | B2 * | 10/2005 | Boucher et al. | 73/152.48 |
| 6,957,576 | B2 * | 10/2005 | Skinner et al. | 73/152.51 |
| 7,878,266 | B2 * | 2/2011 | Griffin et al. | 175/40 |
| 2005/0103123 | A1 * | 5/2005 | Newman | 73/862.045 |

OTHER PUBLICATIONS

International Search Report and Written Opinion for International Application No. PCT/NO2009/000399 dated Mar. 1, 2010.

* cited by examiner

*Primary Examiner* — John Fitzgerald
(74) *Attorney, Agent, or Firm* — Patterson & Sheridan, L.L.P.

(57) ABSTRACT

The invention relates to a downhole pressure- and vibration-measuring device integrated in a pipe section as part of a production tubing. The sensor housing of the measuring device with sensors has a two-part clamp on the upper part of the sensor housing, from where an electrical multi-conductor cable connection from at least four, preferably six, nipples in a tube is clamped along the production tubing with bushings through equipment installed in the wellhead to sensors with an electronics and control unit above the wellhead. Evenly spaced radially in an annular space are a first set of strain gauges attached to the outside wall of the production tubing and a second set of strain gauges attached on the inside of the external wall of the sensor housing. Strain gauges are connected by glass penetrators of electrical conductors in cable tubes terminated in the tubing hanger to an electronics unit and a control unit. For the measuring of temperatures, a thermometer will be integrated. Pressure-measurement signals also measure vibration in the production tubing.

4 Claims, 2 Drawing Sheets

DOWNHOLE PRESSURE AND VIBRATION MEASURING DEVICE INTEGRATED IN A PIPE SECTION AS A PART OF A PRODUCTION TUBING

BACKGROUND

The invention relates to a downhole pressure and vibration measuring device integrated in a pipe section as part of a production tubing, as defined in the introduction of the accompanying claim 1.

Downhole instrumentation is used to acquire measuring data in production wells and is an important tool for the optimal control of the production. The reliability of the downhole meters is poor in high temperatures, typically 110° C. or higher. A rule of thumb says that the error rate is doubled for every ten degrees' increase in temperature.

The reduced life of downhole instrumentation in oil and gas wells because of high temperatures is a large problem. In practice, the expenses of a well intervention are too large for malfunctioning downhole instrumentation to be replaced. This is true for subsea wells in particular. Over time, a loss of this instrumentation function may have economic consequences in that the control of the well is not optimal.

Modern measuring systems are typically silicone, sapphire or quartz sensors with electronics. A large number of downhole electronic measuring systems have been installed during the last twenty years, and many studies have been carried out to evaluate the reliability of this type of equipment. One evaluation revealed that only 88% of the installations were still functioning after four years in operation, and a trend showed a drop of 3% per year, indicating that ⅓ of the wells would have lost their downhole monitoring by the end of the well's life.

Other downhole measuring systems are optical-fibre measuring instruments, which can stand high temperatures but are attacked by hydrogen, which blackens the fibres. Measuring instruments with capillary tubes are used primarily for pressure measuring with inert gas, like nitrogen and helium, and in combinations with optical-fibre temperature measurement. Faults may arise by particles blocking bubble tubes, for example through gas leakages, and when pressure chambers are undersized, so that oil will enter gas tubes.

From the patent literature are cited as the background art:

- U.S. Pat. No. 5,226,494 disclosing a downhole tool, in which strain gauges are to register applied forces to initiate a downhole function without using ports in the production tubing or the work string, a method being sought for the reliable activation of the function from the surface. Changes in signals from the strain gauges mounted on a tubular part included in the tool on mechanical influence may be recorded by downhole electronics, and when an activating sequence of influence is recognized, the electronics will release energy stored in the tool, which performs a desired tool function.
- U.S. Pat. No. 6,384,738 disclosing an invention with the same object.

The invention of the application is substantially different from the two mentioned above, with respect to object, embodiment as well as function.

SUMMARY

The present application relates to a downhole pressure and vibration measuring device integrated in a pipe section as part of a production tubing, and the measuring device is characterized by the characteristics set forth in claims.

The object of the invention is to provide a system which is robust in relation to temperature and vibration and has the following functionality:

- measuring internal pressure in the production tubing
- measuring pressure in the annulus between the production tubing and casing of the well
- measuring temperature
- measuring vibration

BRIEF DESCRIPTION OF THE DRAWINGS

FIG. 1 shows a strain gauge monitoring system which is mounted on a pipe section inserted as part of a production tubing 20 in an oil or gas well, sensing the surface strain from pressure inside the production tubing and surface strain is from external pressure in the annulus between the production tubing and the casing in the well.

DETAILED DESCRIPTION

Figure 1C:
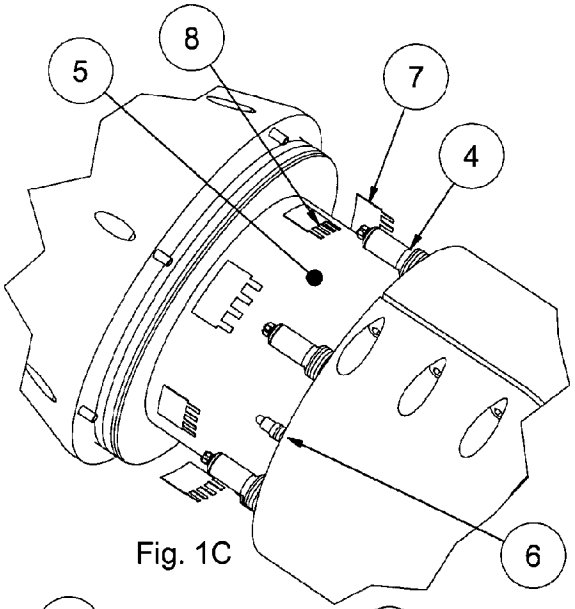
FIG. 1C is a 3D detail of the insides of a sensor housing.
Figure 1D:
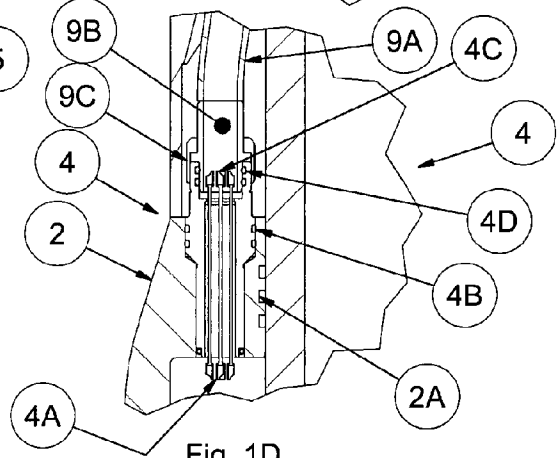
FIG. 1D shows a longitudinal section of a cable termination in detail.
Figure 1B:
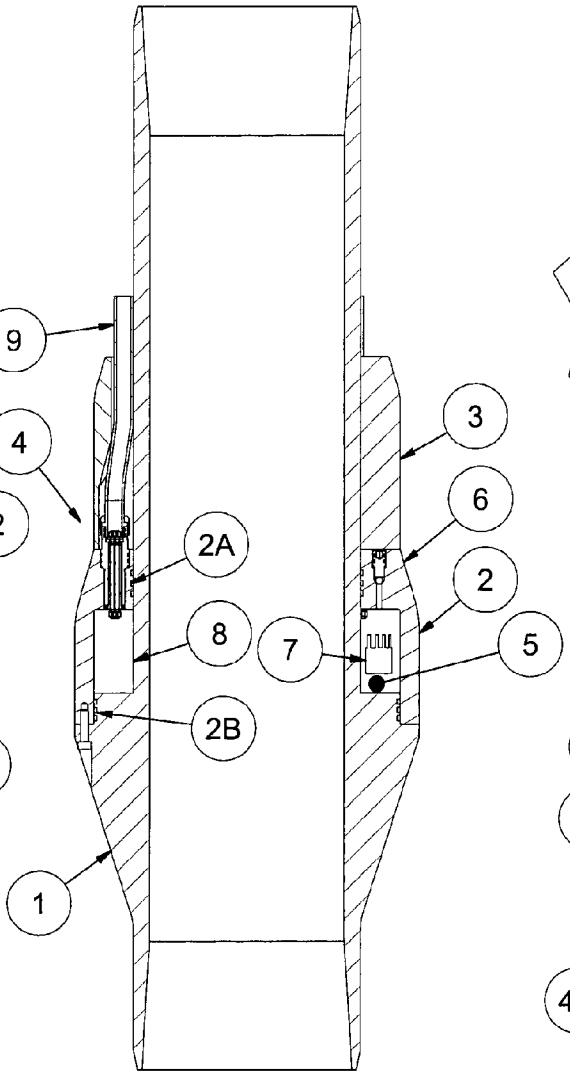
FIG. 1B shows a longitudinal section of the measuring device.
Figure 1A:
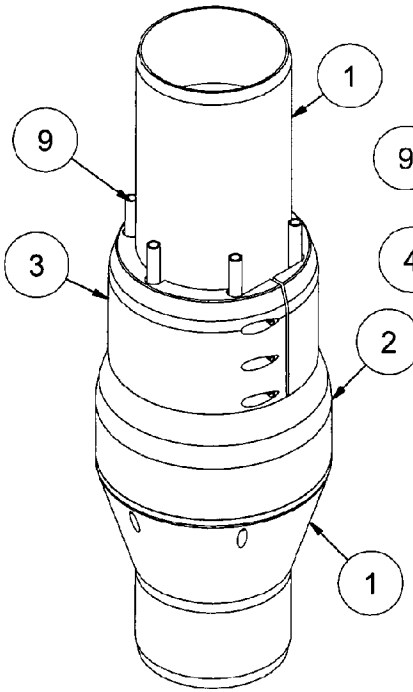
FIG. 1A is a 3D drawing which, viewed from the outside, shows the measuring device installed.

The main parts of the measuring device are a pipe section 1 with a conical part which is joined to a sensor housing 2 and a two-part clamp 3 on the upper end, which protects at least four, and preferably six, glass penetrators 4 connecting corresponding strain gauges 7 and 8 to cable connections inside cable tubes 9A extending up along the production tubing 20 in a multi-conductor cable connection 10 to electrical bushings in the tubing hanger 21 of the well.

With seals 2A/B, the sensor housing 2 forms a tight annular space 5 filled through a filling channel 6 with an inert gas, preferably nitrogen, in the annular space 5 between the external sensor housing 2 and the pipe section 1. The sensor housing 2 protects strain gauges 7, 8 evenly spaced radially on the inside of the sensor housing. The strain gauges 7, 8 are preferably fixed with glue that can stand at least 250° C. on the inside wall of the sensor housing 2 and the outside wall of the production tubing section 1, respectively, so that both the internal pressure and the external pressure acting on the production tubing 20 are measured.

A temperature measurement device may be integrated and signals be carried to the control equipment 11, 12 in a manner corresponding to that of the strain gauge measurements.

The measuring device is connected to the control unit 11 for signal amplification via electrical conductors encased in cable tubes 9A, which are clamped to the production tubing 20 downhole and terminated in the tubing hanger 21 of the well equipment with an electrical multi-conductor cable connection 10 to an electronics unit in the control equipment 11, connected to a control and communication module in the control unit 12 on the outside of the wellhead equipment.

There are wires extending between the strain gauges 7, 8 and the pins 4A of the glass penetrators 4 which extend through the upper end of the sensor housing 2.

The glass penetrators 4 are provided with an external threaded portion and are screwed in through threaded holes in the top of the sensor housing 2, so that external gaskets 4B seal against the material of the upper end of the sensor housing 2 when screwed all the way in. An external tube nut 9C is threaded onto each of the cable tubes 9A before short tube subs 9B with collars on their tubes are welded to the end of the respective tubes 9A by EB (electron beam) welds. The cable tubes 9A come on drums and are terminated on the glass penetrators 4 of the measuring device as part of the installation.

Cable termination means that the conductors projecting at each cable tube end 9B are soldered to the pins 4C of the corresponding glass penetrators 4. The tube sub 9B is inserted into the upper end of the glass penetrator 4 until the collar of the tube sub 9B rests on the upper edge of the glass penetrator 4. Gaskets 4D internally at the top of the glass penetrator 4 seal against the tube end 9B. Finally, the tube nut 9C is screwed onto the external threaded portion at the top of the glass penetrator 4 until it presses the collar of the tube sub 9B against the abutment surface on the top of the glass penetrator 4, the cable tube 9A thereby being anchored to the glass penetrator 4.

By means of a special piece of software, the pressure-measurement signals received from the strain-gauge-based sensors are processed, also to measure vibration in the production tubing 20.

There is no form of electronics placed in the well.

Figure 2:
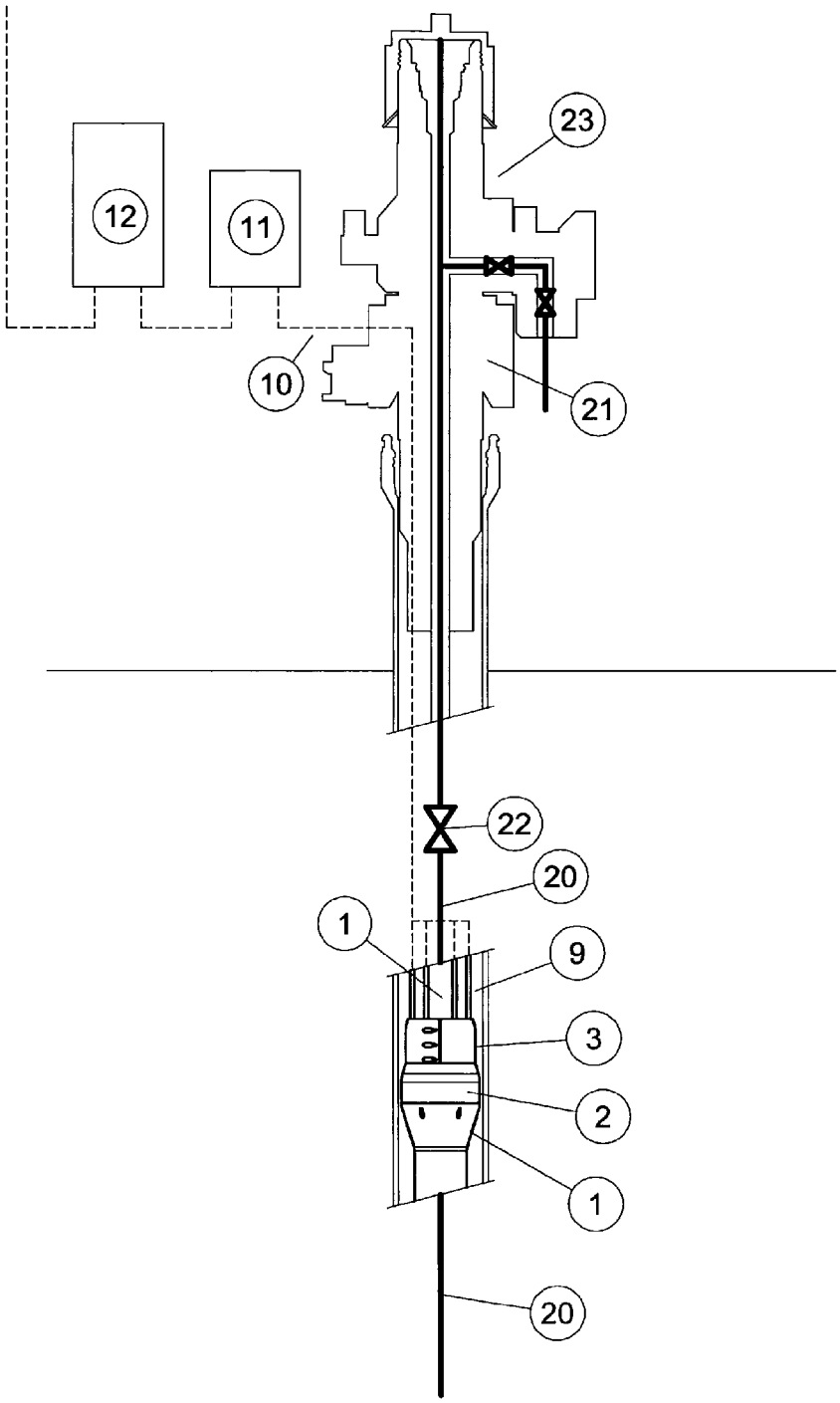
FIG. 2 is a schematic side view of a subsea production well with a strain-gauge-based measuring device therein.

FIG. 2 shows a schematic side view of a subsea production well, in which a production tubing 20 with a strain-gauge-based measuring device in a sensor housing 2 and a downhole safety valve 22 extends up to a horizontal wellhead 23.

The invention claimed is:

1. A downhole pressure and vibration measuring device integrated in a pipe section as part of a production tubing, the measuring device being constituted by a sensor housing with sensors and a two-part clamp on the upper part of the sensor housing, from where an electrical multi-conductor cable connection from at least four, nipples in cable tubes is clamped along the production tubing with bushings through equipment installed in the wellhead to an electronics/amplifier unit and a control unit above the wellhead, wherein the sensor housing forms an annular space around the pipe section and is filled with an inert gas; that evenly spaced radially in the annular space are a first set of strain gauges attached to the outside wall of the production tubing and a second set of strain gauges attached to the inside of the external wall of the sensor housing; that the strain gauges are connected by glass penetrators to electrical conductors in cable tubes, which are terminated in the tubing hanger of the well equipment, to an electronics unit and a control unit.

2. The downhole pressure and vibration measuring device according to claim 1, wherein measurement of temperatures is performed by an integrated thermometer and that vibration in the production tubing is measured through the pressure-measurement signals.

3. The downhole pressure and vibration measuring device according to claim 1, wherein there are six nipples.

4. The downhole pressure and vibration measuring device according to claim 1, wherein the inert gas is nitrogen.

* * * * *